US007548701B2

(12) United States Patent
Ochiai

(10) Patent No.: US 7,548,701 B2
(45) Date of Patent: Jun. 16, 2009

(54) REUSABLE IMAGE FORMING MEDIUM AND APPARATUS FOR REUSING THE IMAGE FORMING MEDIUM

(75) Inventor: Norikazu Ochiai, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 126 days.

(21) Appl. No.: 11/626,498

(22) Filed: Jan. 24, 2007

(65) Prior Publication Data

US 2008/0175604 A1 Jul. 24, 2008

(51) Int. Cl.
*G03G 15/00* (2006.01)

(52) U.S. Cl. ..... 399/1; 399/390

(58) Field of Classification Search ..... 399/1, 399/127, 341, 390, 411
See application file for complete search history.

(56) References Cited

U.S. PATENT DOCUMENTS 5,353,108 A * 10/1994 Tsukamoto ..... 399/390
5,970,272 A * 10/1999 Kobayashi et al. ..... 399/1
6,529,704 B1 * 3/2003 Kurita et al. ..... 399/390
6,832,055 B2 12/2004 Ochiai

FOREIGN PATENT DOCUMENTS

JP 11-194508 7/1999
JP 11-194685 7/1999

* cited by examiner

*Primary Examiner*—Sandra L Brase
(74) *Attorney, Agent, or Firm*—Turocy & Watson, LLP

(57) ABSTRACT

For a sheet paper used for forming a toner image or ink image, a surface layer that can be stripped is stacked on a plastic layer. A sliding member is caused to slide in contact with the plastic layer of the used sheet paper on which a toner image or ink image has been formed, and the toner image or ink image is stripped off the plastic layer together with the surface layer. A new surface layer is formed on the plastic layer to regenerate the sheet paper, and the sheet paper is thus made reusable.

14 Claims, 3 Drawing Sheets

REUSABLE IMAGE FORMING MEDIUM AND APPARATUS FOR REUSING THE IMAGE FORMING MEDIUM

BACKGROUND OF THE INVENTION

1. Field of the Invention

The present invention relates to an image forming medium that can be used for a printer apparatus, a copy machine, a facsimile apparatus and the like and particularly that is made reusable by removing a toner image or ink image formed thereon, an apparatus for reusing the image forming medium, a method for reusing the image forming medium, and an image forming apparatus.

2. Description of the Related Art

Recently, reuse of an image forming medium has been realized, where image information formed by toner or ink on the image forming medium is removed so that the same image forming medium is repeatedly used for a new image information output. For example, JP-A-11-194685 or JP-A-11-194508 discloses a technique of forming information image with toner or ink on an image forming medium having a photocatalyst-containing surface layer on the surface of a base material or plastic board, then casting near-ultraviolet rays to the surface layer to weaken the adhesion between the image forming medium and the image, then rubbing the image with a brush to erase the image, regenerating the image forming medium, and enabling repeated use of it.

However, with such a traditional image forming medium, it takes a long time to cast light to the photocatalyst in the surface layer in order to effectively remove the image. Therefore, the time required for regenerating the image forming medium is long and the regeneration of the image forming medium may not be able to catch up with the demand for the reuse of the image forming medium.

Thus, an image forming medium, an apparatus for reusing the image forming medium, a method for reusing the image forming medium, and an image forming apparatus are desired that enable easy provision of a necessary reuse image forming medium by reducing the time for removing image information formed on the image forming medium and thereby reducing the time for regenerating the image forming medium.

SUMMARY OF THE INVENTION

An aspect of the present invention is to enable easy removal of image information formed on an image forming medium, reduce the time for regenerating the image forming medium, and enable easy supply of a required quantity of reuse image forming media.

According to an embodiment of the invention, an image forming medium includes a plastic layer, and a surface layer that is stacked on the plastic layer, that holds an image formed thereon with toner or ink and that can be stripped off the plastic layer together with the image by a sliding member in contact with the plastic layer.

DETAILED DESCRIPTION OF THE INVENTION

Figure 1:
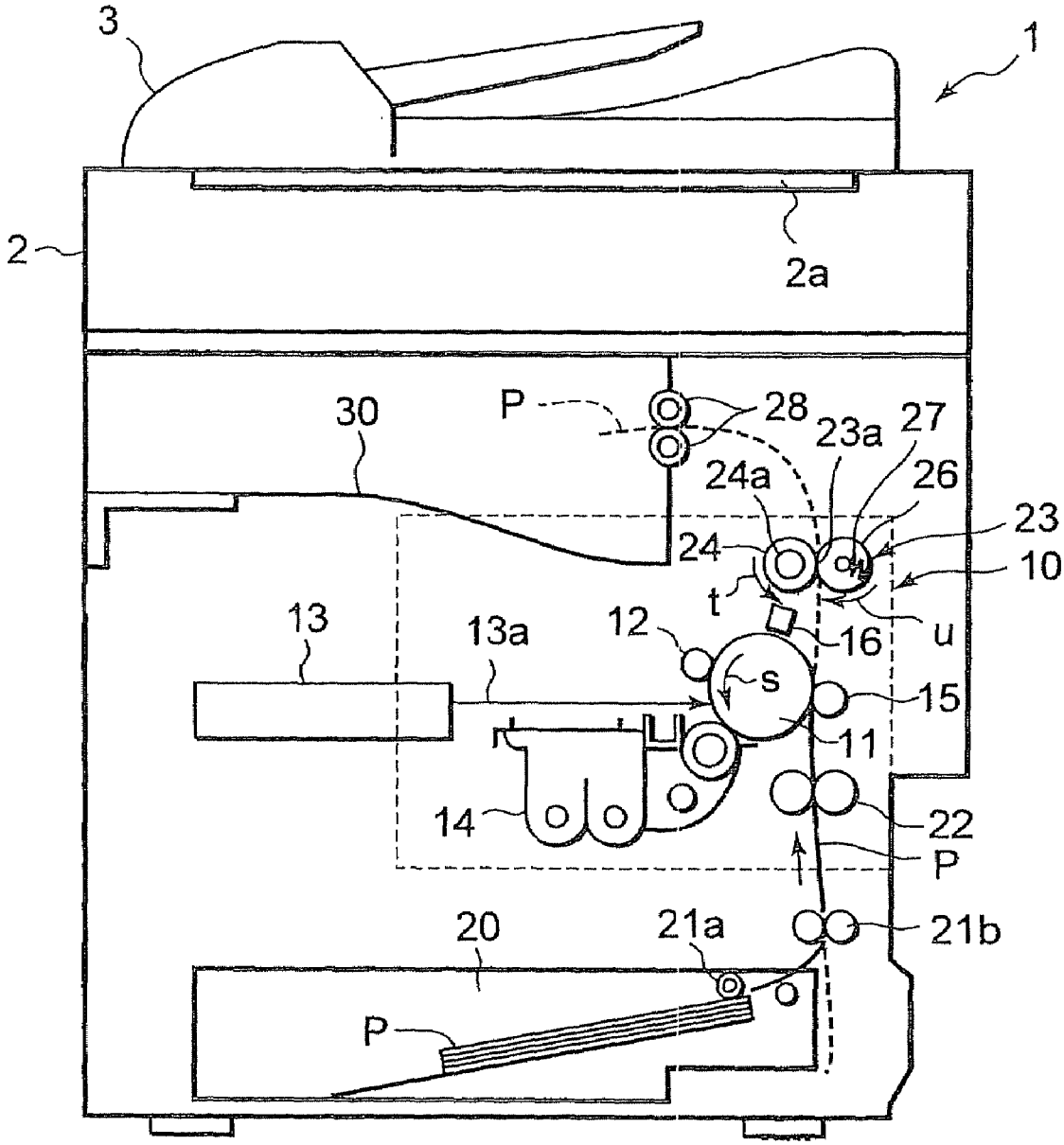
FIG. 1 is a schematic configuration view showing an image forming apparatus according to an embodiment of the invention.

Hereinafter, an embodiment of the invention will be described in detail with reference to the accompanying drawings. FIG. 1 is a schematic configuration view showing an image forming apparatus 1 according to an embodiment of the invention. The image forming apparatus 1 is capable of forming an image on a sheet paper P, which is an image forming medium to be reused repeatedly. A scanner 2 that reads an original is provided on the top of the image forming apparatus 1. The scanner 2 has an automatic original feeder 3 that supplies an original to an original table 2*a*. The image forming apparatus 1 has a cassette device 20 that supplies the sheet paper P. The paper feed cassette device 20 is capable of supplying both normal papers and the sheet papers P that are to be used repeatedly. A photoconductive drum 11, which is an image carrier of the image forming apparatus 1, is driven in the direction of an arrow s.

An image forming unit 10 that forms a toner image on the photoconductive drum 11 is arranged round the photoconductive drum 11. The image forming unit 10 has a charger device 12, an exposure device 13 and a developing device 14. Moreover, a transfer and stripping device 15 and a cleaner 16 are arranged around the photoconductive drum 11.

As the photoconductive drum 11 rotates, its surface is uniformly charged. After a laser beam 13*a* corresponding to image information from the scanner 2 or the like is cast to the photoconductive drum 11 by the exposure device 13, toner is supplied by the developing device 14 and a toner image is formed thereon. The toner image on the photoconductive drum 11 is transferred to the sheet paper P at the position of the transfer and stripping device 15. While the toner image is formed on the photoconductive drum 11, the sheet paper P is taken out from the cassette device 20 by a pickup roller 21*a*, carried to a resist roller 22 by a paper feed roller 21*b*, and supplied to the position of the transfer and stripping device 15 synchronously with the toner image on the photoconductive drum 11.

The sheet paper P to which the toner image on the photoconductive drum 11 has been transferred is carried toward a fixing device 23 after being stripped. After the transfer of the toner image ends, the photoconductive drum 11 is cleaned by the cleaner 16 to remove the remaining toner and the next print can be made thereon.

The fixing device 23 has a heat roller 24 having a heater device 24*a*, and a press roller 26 pressed in contact with this heat roller 24. The heat roller 24 is driven in the direction of an arrow t. The press roller 26 is pressed in contact with the heat roller 24 by a pressurizing mechanism 27. The press roller 26 rotates in the direction of an arrow u, following the heat roller 24. The toner image is fixed onto the sheet paper P by heating and pressurizing while it passes through a nipping part 23*a* between the heat roller 24 and the press roller 26. A pair of paper discharge rollers 28 is provided downstream of the fixing device 23, and the sheet paper P after the fixation is discharged to a paper discharge unit 30. The formation of the image is thus completed.

Figure 2:
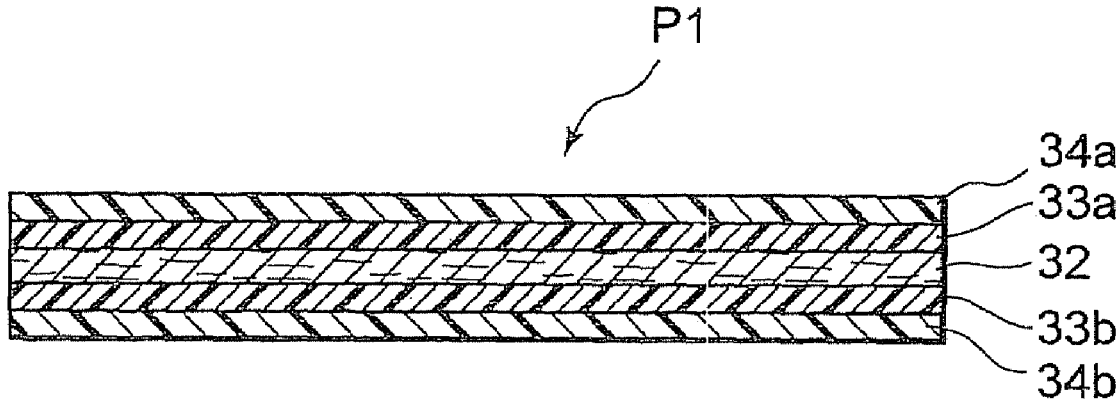
FIG. 2 is a configuration view showing a first sheet paper according to an embodiment of the invention.

Next, the sheet paper P used in such an image forming apparatus 1 will be described in detail. First, a first sheet paper P1 is shown in FIG. 2. The first sheet paper P1 has a paper material 32 with a thickness of 90 to 100 μm having both sides coated with polyethylene naphthalate layers 33*a* and 33*b*, which are plastic layers, each being approximately 30 μm thick. The polyethylene naphthalate layers 33*a* and 33*b* are applied onto the paper material 32 at 200 to 250° C. The concave-convex part of the paper material 32 is thus smoothed. Since the polyethylene naphthalate layers 33*a* and 33*b* are applied onto the paper material 32 at a high temperature, the polyethylene naphthalate layers 33*a* and 33*b* are not easily stripped off. Surface layers 34*a* and 34*b* made of, for example, KTP01, which is an inorganic silica binder resin made by Photocatalytic Materials Inc., are stacked to approximately 6 μm on the plastic layers 33*a* and 33*b*.

An identification logo is printed on the polyethylene naphthalate layers 33*a* and 33*b* so that the first sheet paper P1 can be identified as a reuse paper. The identification logo may also be printed on the paper material 32.

The inorganic silica binder resin is a liquid resin formed by mixing silicon dioxide, water, surfactant and acrylic resin. The viscosity of the inorganic silica binder resin is approximately 1 to 3 [mPa·s] at 22±1C.°. Even in the solid state, the inorganic silica binder resin does not lower the flexibility of the paper material 32 and the polyethylene naphthalate layers 33*a* and 33*b*. Also, the inorganic silica binder resin will not be stripped off even if a person touches the first sheet paper P and rubs it with a finger. However, the inorganic silica binder resin can easily be stripped off the polyethylene naphthalate layers 33*a* and 33*b* if it is rubbed with a nail or a sharp-cornered object.

Therefore, if writing onto the first sheet paper P1 is needed while the first sheet paper P1 on which the toner image has been formed by the image forming apparatus 1 is used as paper information, it should be written with a soft-lead writing tool such as a felt-tip pen. This prevents the surface layers 34*a* and 34*b* from being stripped off at the time of writing.

Figure 3:
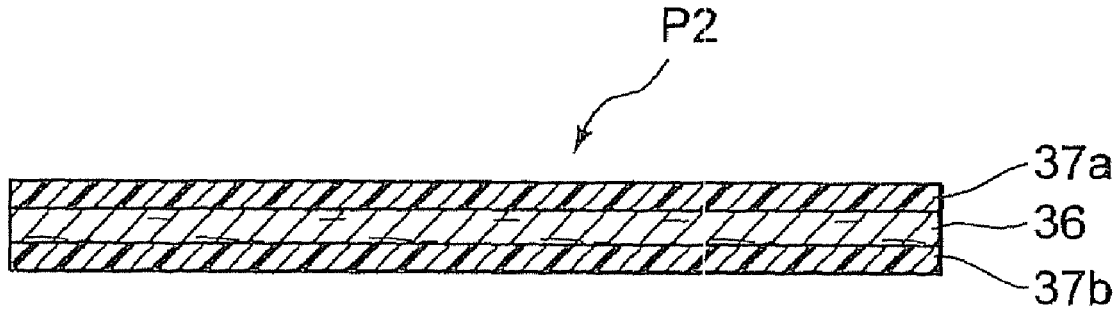
FIG. 3 is a configuration view showing a second sheet paper according to an embodiment of the invention.

Next, a second sheet paper P2 is shown in FIG. 3. The second sheet paper P2 has a polyethylene naphthalate film 36 with a thickness of 120 μm, which is a plastic layer, and surface layers 37*a* and 37*b* made of, for example, KTP01, which is an inorganic silica binder resin made by Photocatalytic Materials Inc., and stacked on the polyethylene naphthalate film to approximately 6 μm. An identification logo is printed on the polyethylene naphthalate film 36 so that the second sheet paper P2 can be identified as a reuse paper.

The surface layers 37*a* and 37*b* do not lower the flexibility of the polyethylene naphthalate film 36. Also, the surface layers 37*a* and 37*b* will not be stripped off even if a person rubs the second sheet paper P with a finger. However, the surface layers 37*a* and 37*b* can easily be stripped off the polyethylene naphthalate film 36 if it is rubbed with a nail or a sharp-cornered object. As with the first sheet paper P1, when writing onto the second sheet paper P2 is needed, it is written with a soft-lead writing tool such as a felt-tip pen.

The polyethylene naphthalate film 36 of the second sheet paper P2 is not limited to a transparent one, and it may be turbid in white. If it is turbid in white, the toner image can be easily read against the white background as in the case of using a paper material.

Figure 4:
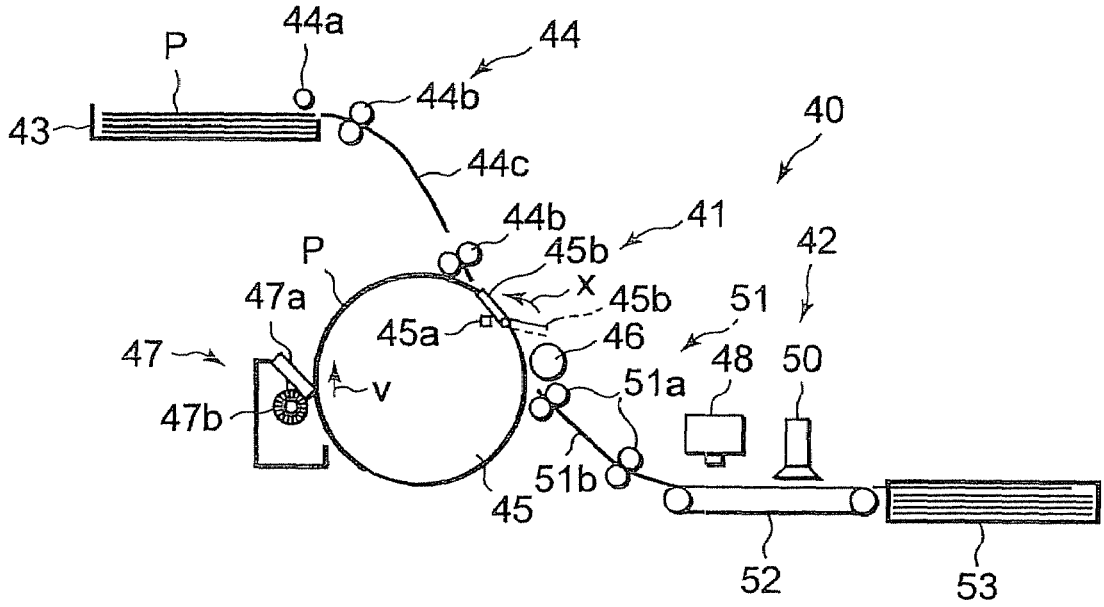
FIG. 4 is a schematic configuration view showing an apparatus for reusing a sheet paper according to an embodiment of the invention.

The image forming apparatus 1 is capable of forming a toner image on the reuse sheet paper P like the first or second sheet paper P1 or P2. After a desired toner image is formed on such a reuse sheet paper P and the sheet paper P is used as paper information, the used sheet paper P is regenerated for reuse. FIG. 4 shows a reusing apparatus 40 for the sheet paper P. The reusing apparatus 40 is capable of regenerating both the first and second sheet papers P1 and P2. The reusing apparatus 40 has a removing unit 41 that removes a toner image formed on the sheet paper P together with the surface layer, and a regenerating unit 42 as a layer forming member that forms a new surface layer on the sheet paper P.

The removing unit 41 has a cassette 43 that houses the used sheet paper P, a paper winding drum 45 that rotates in the direction of an arrow v and that winds the used sheet paper P thereon and fixedly supports the sheet paper P, and a first carrier mechanism 44 that takes out the sheet paper P from the cassette 43 and carries it to the paper winding drum 45. The first carrier mechanism 44 has a pickup roller 44*a*, a first carrier roller 44*b*, and a first carrier guide 44*c*.

An electric potential of approximately 1000 to 6000 V is provided to the paper winding drum 45, thus electrostatically attracting the sheet paper P. The sheet paper P is thus wound on the paper winding drum 45. Also, to wind the potential sheet paper P on the paper winding drum 45, a ventilation hole may be opened on the surface of the paper winding drum 45 and the air in the paper winding drum 45 may be sucked to attach the sheet paper P to the surface of the paper winding drum 45.

The paper winding drum 45 has a position sensor 45*a* that detects the sheet paper P, and an inserting plate 45*b* that inserts and fixes the leading end of the sheet paper P into the drum 45. A pickup roller 46 that takes out the leading end of the sheet paper P inserted into the paper winding drum 45, and a blade mechanism 47, are provided around the paper winding drum 45.

The blade mechanism 47 is a sliding member and has a plastic blade 47*a* and a cleaning brush 47*b* for cleaning the distal end of the blade 47*a*. If the sheet paper P is the first sheet paper P1, the blade 47*a* contacts the smooth polyethylene naphthalate layer 33*a*, 33*b* and strips the toner image off together with the surface layer 34*a*, 34*b*. If the sheet paper P is the second sheet paper P2, the blade 47*a* contacts the smooth polyethylene naphthalate film 36 and strips the toner image off together with the surface layer 37*a*, 37*b*.

The regenerating unit 42 has a sprayer 48 as a layer forming member that sprays the inorganic silica binder to the sheet paper P from which the surface layers have been removed by the removing unit 41, a drier 50 that dries the inorganic silica binder sprayed on the sheet paper P, a second carrier mechanism 51 that carries, toward the sprayer 48, the paper taken out from the paper winding drum 45 by the pickup roller 46, a carrier belt 52, and a housing box 53. The second carrier mechanism 51 has a second carrier roller 51*a* and a second carrier guide 51*b*.

Next, the operation will be described. When regenerating the sheet paper P, the used sheet paper P is collected and set in the cassette 43. At this time, it is determined whether the used sheet paper P can be regenerated or not, on the basis of whether the sheet paper P has the logo thereon or not. When the regeneration processing is started, the sheet paper P is taken out from the cassette 43 by the pickup roller 44*a* and carried toward the paper winding drum 45 by the first carrier mechanism 44. When the sheet paper P has reached the paper winding drum 45 and the position sensor 45*a* has detected the leading end of the sheet paper P, the inserting plate 45*b* rotates in the direction of an arrow x from an open state as indicated by a dotted line in FIG. 4. Thus, the inserting plate 45 inserts the leading end of the sheet paper P into the paper winding drum 45 and then closes. At the same time, the paper winding drum 45 rotates in the direction of the arrow v. Also, since an electric potential is provided to the paper winding drum 45, the sheet paper P is electrostatically attracted to the paper winding drum 45 and is wound on the paper winding drum 45.

When the inserting plate 45 has passed the distal end of the blade 47*a* in accordance with the rotation of the paper winding drum 45, the blade 47*a* is deformed toward the paper winding drum 45 and the distal end of the blade 47*a* is pressed in contact with the sheet paper P. Thus, if it is the first sheet paper P1, the distal end of the blade 47*a* contacts the polyethylene naphthalate layer 33*a*, 33*b*. After that, the blade 47*a* strips the toner image together with the inorganic silica binder of the surface layer 34*a*, 34*b*, off the polyethylene naphthalate layer 33*a*, 33*b*. If it is the second sheet paper P2, the distal end of the blade 47*a* contacts the polyethylene naphthalate film 36. After that, the blade 47*a* strips the toner image together with the inorganic silica binder of the surface layer 37*a*, 37*b*, off the polyethylene naphthalate film 36.

When the rear end of the sheet paper P has passed the blade 47*a* and the surface layer and the toner image have been stripped off the sheet paper P, the deformation of the blade 47*a* toward the paper winding drum 45 is canceled and the distal end of the blade 47*a* is moved away from the paper winding drum 45. Also, during this process, the inorganic silica binder and toner adhering to the distal end of the blade 47*a* is removed by the cleaning brush 47*b*. After that, the paper winding drum 45 is rotated further. As the inserting plate 45*b* has passed the position of the pickup roller 46, the paper winding drum 45 is stropped. After the paper winding drum 45 is stopped, the inserting plate 45*b* is opened into the open state indicated by the dotted line. Next, the pickup roller 46 is driven and the leading end of the sheet paper P is taken out of the paper winding drum 45. The reaching of the inserting plate 45*b* to the position of the blade 47*a*, or the passing of the rear end of the sheet paper P over the blade 47*a*, and the passing of the inserting plate 45*b* over the position of the pickup roller 46 may be detected in accordance with the amount of rotation of the paper winding drum 45 or may be arbitrarily detected by a sensor or the like.

After the leading end of the sheet paper P is taken out of the paper winding drum 45 by the pickup roller 46, the sheet paper P is carried toward the carrier belt 52 by the second carrier mechanism 51. When the sheet paper P has reached the position of the sprayer 48 on the carrier belt 52, KTP01, which is the inorganic silica binder, is sprayed to the sheet paper P by the sprayer 48. Moreover, after the inorganic silica binder is dried at a temperature of approximately 160° C. by the drier 50, the sheet paper is housed into the housing box 53. Thus, a new surface layer is stacked on one side of the sheet paper P and the regeneration of one side of the sheet paper P ends. Since the inorganic silica binder is dried at a relatively low temperature and it is thinly applied to the thickness of approximately 6 μm, it does not strongly adhere to the polyethylene naphthalate layers 33*a* and 33*b* or the polyethylene naphthalate film 36. That is, the inorganic silica binder formed on the polyethylene naphthalate layers 33*a* and 33*b* or the polyethylene naphthalate film 36 is stacked in such a manner that it will not be stripped off by rubbing with a hand or the like but it can be easily stripped off by rubbing with a nail or a sharp-cornered object.

After that, the similar regeneration processing is carried out on the remaining side of the sheet paper P, and new surface layers are stacked on both sides. The regeneration processing for the sheet paper P is thus completed. The regenerated sheet paper P can be provided as a reuse paper for forming an image thereon.

According to this embodiment, a toner image is formed on the sheet paper P having the surface layers of inorganic silica binder on the polyethylene naphthalate layers 33*a* and 33*b* or the polyethylene naphthalate film 36. When regenerating the sheet paper P, the toner image formed on the sheet paper P is stripped off together with the inorganic silica binder by using the blade 47*a*. That is, the toner image on the sheet paper P can be removed in a short time without having to wait for a toner decomposition time based on a chemical reaction. As a result, the time for regenerating the sheet paper P can be reduced and a required quantity of reuse sheet papers P can be provided. Also, since the sheet paper P that can be regenerated has a logo thereon, the sheet paper P that can be regenerated can be easily distinguished from a sheet paper that cannot be regenerated.

The present invention is not limited to the above embodiment and various modifications can be made without departing from the scope of the invention. For example, the image forming medium may have, only on its one side, a surface layer that can be stripped from a plastic layer, and the material, thickness and the like of the plastic layer and the surface layers are not limited. Moreover, the processing temperature in the case of forming the plastic layer or the surface layer is not limited, either. However, it is preferable that the processing temperature for the plastic layer is higher than the fixing temperature so that the plastic layer is difficult to strip off the paper material and so that the plastic layer is not affected by the fixation of the toner image. Also, it is preferable that the processing temperature for the surface layer is a relatively low temperature of 160° C. or lower so that its thickness is small and so that the surface layer can be easily stripped off the plastic layer.

Figure 5:
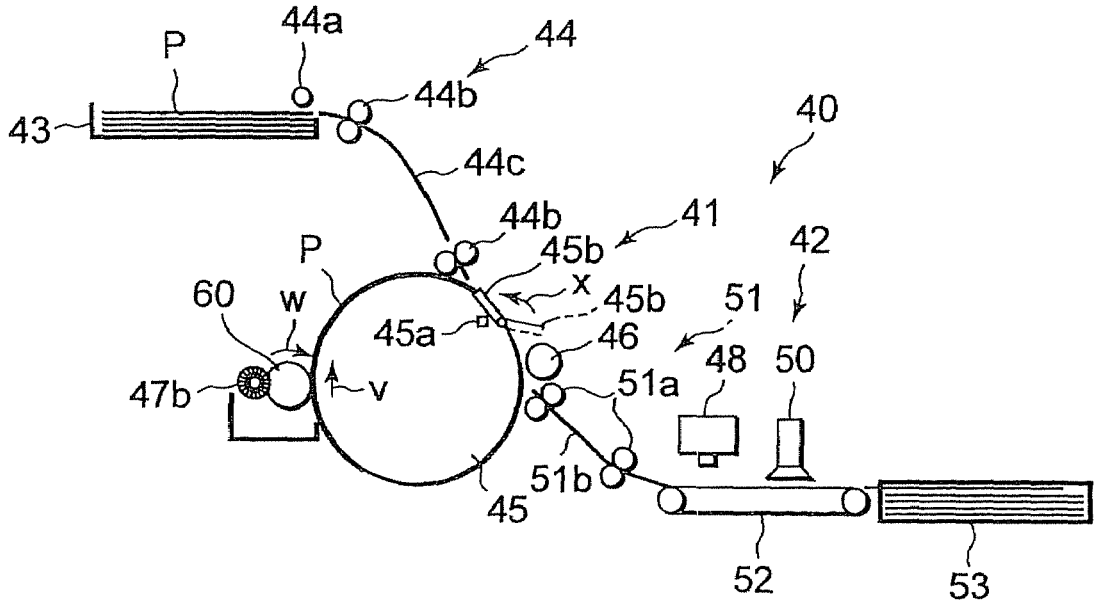
FIG. 5 is a schematic configuration view showing a modification of the invention.

Also, the image forming apparatus is not limited to the apparatus that forms a toner image by electrophotography, and it may form an ink image by an ink jet system. Moreover, the structure and the like of the apparatus for reusing the image forming medium are not limited. For example, as the sliding member, a rubbing roller 60 may be used instead of the blade as in a modification shown in FIG. 5. The rubbing roller 60 is made of an unwoven cloth, fabric or textile. The rubbing roller 60 rotates in the direction of an arrow w, against the direction of carrying the sheet paper P in the direction of the arrow v by the paper winding drum 45. When removing the toner image, the rubbing roller 60 slides in contact with the plastic layer of the sheet paper P and can strip the toner image on the sheet paper P together with the surface layer. The inorganic silica binder, toner and the like adhering to the rubbing roller 60 are removed by the brush roller 47*b*. Moreover, the layer forming member may be the one that forms a new surface layer by using a coating device or the like, instead of the sprayer.

What is claimed is:

1. An image forming medium comprising:

a plastic layer; and a surface layer that is stacked on the plastic layer, that holds an image formed thereon with toner or ink and that can be stripped off the plastic layer together with the image by a sliding member in contact with the plastic layer, wherein the surface layer is an inorganic silica binder resin layer.

2. The image forming medium according to claim 1, wherein the plastic layer is stacked on a paper material.

3. The image forming medium according to claim 2, wherein the plastic layer or the paper material has a logo indicating that it is reusable.

4. The image forming medium according to claim 1, wherein the plastic layer has a logo indicating that it is reusable.

5. An apparatus for reusing an image forming medium, comprising:

a sliding member configured to come in contact with a plastic layer of the image forming medium and to strip a surface layer stacked on the plastic layer holding an image formed with toner or ink, off the plastic layer, together with the image; and a layer forming member configured to form, on the plastic layer from which the surface layer has been stripped, a new surface layer holding an image formed with toner or ink that can be stripped off the plastic layer, wherein the layer forming member has a sprayer configured to spray a material of the surface layer onto the plastic layer, and a drier configured to dry the material sprayed on the plastic layer.

6. The apparatus for reusing the image forming medium according to claim 5, wherein the sliding member is a blade member.

7. The apparatus for reusing the image forming medium according to claim 5, wherein the sliding member is a rubbing roller member configured to rotate in a direction against a direction of carrying the plastic layer.

8. A method for reusing an image forming medium, comprising:

stripping a surface layer stacked on a plastic layer of the image forming medium and holding an image formed with toner or ink, off the plastic layer, together with the image; and forming, on the plastic layer from which the surface layer has been stripped, a new surface layer holding an image formed with toner or ink that can be stripped off the plastic layer, wherein after a material of the surface layer is sprayed onto the plastic layer, the material is dried to form the surface layer.

9. The method for reusing the image forming medium according to claim 8, wherein the plastic layer is stripped by using a blade member.

10. The method for reusing the image forming medium according to claim 8, wherein the plastic layer is stripped by using a rubbing roller member configured to rotate in a direction against a direction of carrying the plastic layer.

11. An image forming apparatus comprising:

an image carrier;

an image forming unit configured to form a toner image on the image carrier; and a transfer unit configured to transfer the toner image formed on the image carrier to an image forming medium;

wherein the image forming medium has, on a plastic layer, a new surface layer that can be stripped off the plastic layer and that holds an image formed with toner or ink, the surface layer of the image forming medium is an inorganic silica binder resin layer.

12. The image forming apparatus according to claim 11, wherein the image forming medium has the plastic layer stacked on a paper material.

13. The image forming apparatus according to claim 12, wherein the image forming medium has, on the plastic layer or the paper material, a logo indicating that it is reusable.

14. The image forming apparatus according to claim 11, wherein the image forming medium has, on the plastic layer, a logo indicating that it is reusable.

* * * * *